United States Patent [19]

Hersh

[11] Patent Number: 4,988,286

[45] Date of Patent: Jan. 29, 1991

[54] SMOKELESS IGNITOR

[75] Inventor: Stuart Hersh, New City, N.Y.

[73] Assignee: Electric Power Technologies, Inc., Berkeley, Calif.

[21] Appl. No.: 323,593

[22] Filed: Mar. 14, 1989

[51] Int. Cl.[5] ..... F23C 5/28

[52] U.S. Cl. ..... 431/175; 431/285; 431/187; 431/188; 431/8; 431/9; 239/434

[58] Field of Search ..... 431/174, 175, 285, 354, 431/187, 188; 239/434

[56] References Cited

U.S. PATENT DOCUMENTS

| | | | |
|---|---|---|---|
| 2,414,459 | 1/1947 | Fletcher | 431/174 |
| 2,831,535 | 4/1958 | Lange | 431/188 |
| 3,088,681 | 5/1963 | McCutcheon | 431/285 |
| 3,867,092 | 2/1975 | Sage et al. | 431/175 |
| 4,095,929 | 6/1978 | McCartney | 431/188 |
| 4,162,140 | 7/1979 | Reed | 431/175 |
| 4,601,428 | 7/1986 | Kurogo | 431/354 |
| 4,784,043 | 11/1988 | Kobayashi et al. | 431/174 |

*Primary Examiner*—Carroll B. Dority

*Attorney, Agent, or Firm*—Armstrong, Nikaido, Marmelstein, Kubovcik & Murray

[57] ABSTRACT

The smokeless ignitor of the present invention prevents visible emissions upon cold or hot start-up of coal-fired or oil-fired utility boilers. The smokeless ignitor satisfies flame stability and combustion requirements by establishing a flame with 15–30% mass recirculation rate, a recirculation zone length of 0.75–1.5 effective throat diameters, a spray SMD of less than 120 microns and a STU value of ±50% or less.

13 Claims, 13 Drawing Sheets

FIG. 9
PRIOR ART
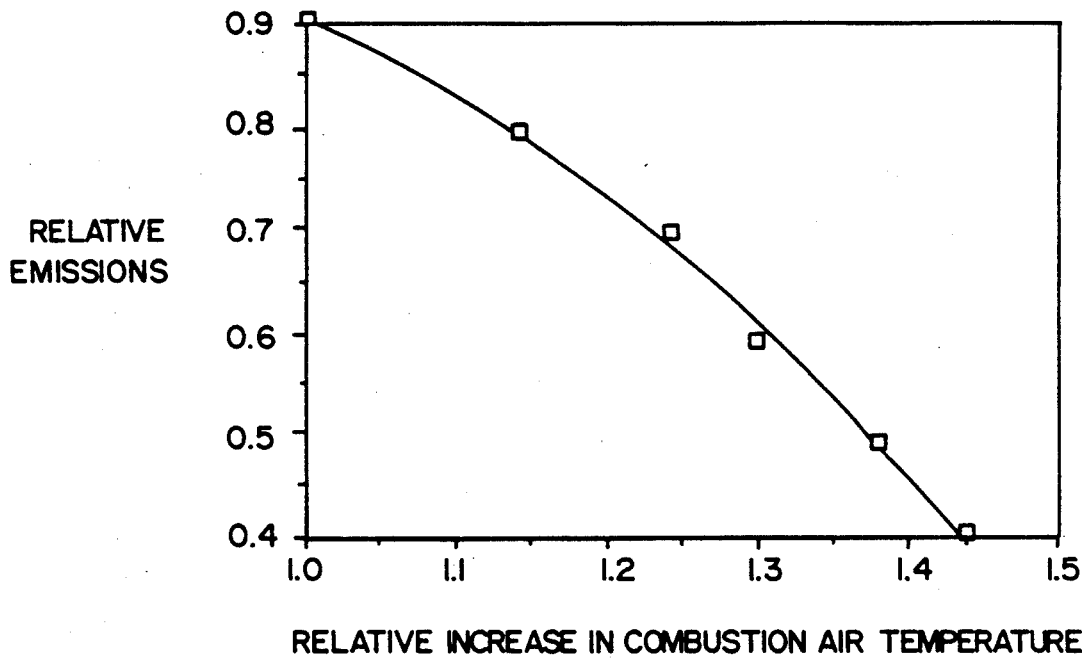
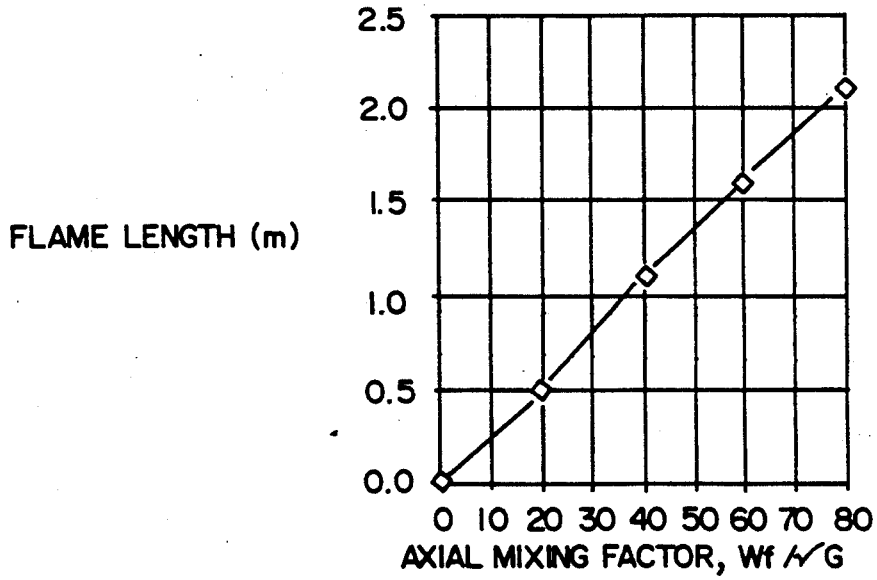
FIG.11 PRIOR ART

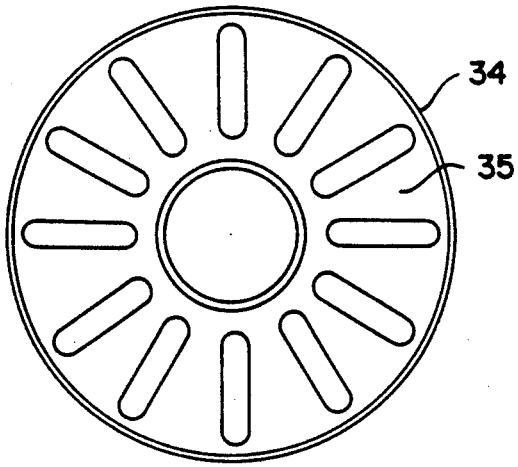
FIG. 16A
FIG. 16B
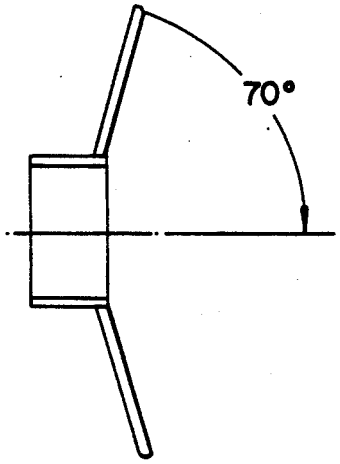
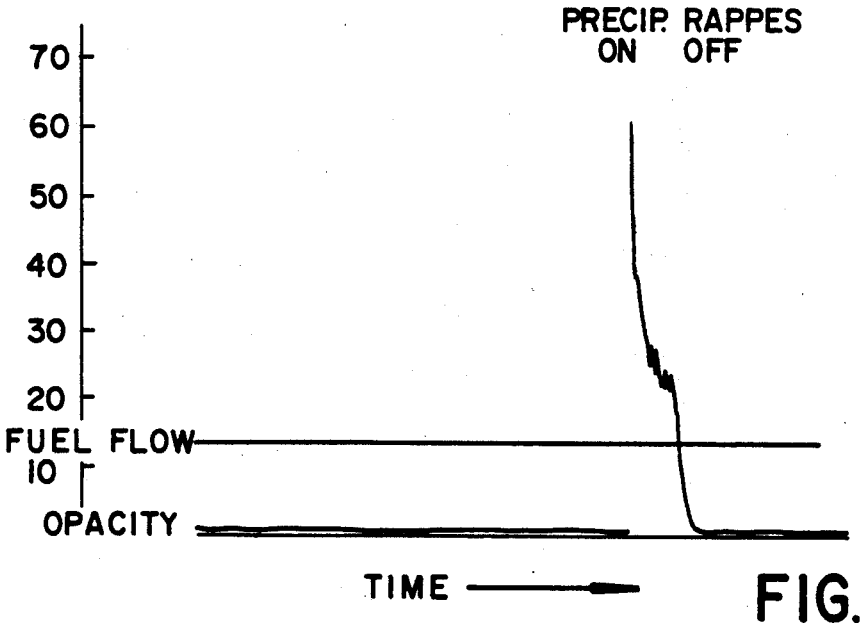
FIG. 18

SMOKELESS IGNITOR

FIELD OF THE INVENTION

The smokeless ignitor of the present invention enables the start-up and initial heating of a large fossil-fuel powered steam generator (i.e., boiler) from cold conditions without any visible emissions from the exhaust stack.

BACKGROUND OF THE INVENTION

One type of boiler, which can be found at Brandon Shores Station of Baltimore Gas and Electric Company, is a pulverized coal fired boiler having rows of burners situated on opposing furnace walls, for example, five rows of five burners. Ignitors, identified as "lighters", are installed in each burner. The ignitors are used to warm up the boiler and ignite the pulverized coal flames. Combustion air is distributed to the burners by a compartmented windbox. As generically illustrated in FIG. 1, the burner rows 1 are grouped in compartments 2 with air flows controlled by dampers 3 and measured using air foils 4 at both ends. This design permits balancing of air flows between compartments without changing burner register or vane settings, thus, effectively uncoupling air flow re-distribution between burners from burner aerodynamics.

During start-up, all burner inlet dampers are open and a minimum air flow of 25% of full load air is established. The minimum air flow specification is categorized as a "safe operating practice". It is generally referred to as a purge requirement to flush-out pockets of combustible (even explosive) mixtures of gases from within the boiler enclosure. This practice has been adopted by most utility boiler operations in the U.S. and is based on recommendations from insurance underwriters.

The principal features of the burners are illustrated in FIG. 2. Coal from the pulverizer is transported to the burner in a primary air flow (normally 10–20% of the total combustion air requirement) and is directed into the furnace through a central coal pipe 5. A distributor 6, mounted at the inlet, is intended to minimize flow mal-distributions within the coal pipe. Additional combustion air enters the burners through two cylindrical registers 6.1 outer and 6.2 inner. The register dampers can be rotated from a fully closed to an almost radial direction. The dampers are intended to be used to establish the relative air flows between the inner and outer annular regions of the burner.

A set of "spin vanes" 6.3 are located in the annular space between the coal pipe and the inner register sleeve. These vanes rotate around radial axes and can induce flow directions from clockwise to counterclockwise. The midpoint of the vane's rotation provides axial flow. While the functions of the spin vanes is to provide only enough turbulence to the inner air to establish an ignition zone and maintain stable combustion, their location and design alone provides a means for independently controlling the swirl in the inner annulus while maintaining a desired inner/outer air flow ratio.

The control rods for the registers and spin vanes are connected to levers outside the burner faceplate. The lever positions are set by engaging notches in a fixed plate 6.4. Once determined (during the initial start-up of the unit) the register and vane positions are designed to be kept at these "proper" settings under all operating conditions including; purge, light-off and firing cycles.

As illustrated in FIGS. 3*a* and 3*b*, the ignitors consist of an air atomized light oil fired burner 7, a high energy spark probe 8, and a "lighter shield" 9 incorporated into a drive and support assembly 10. A separate pneumatic drive for the spark probe allows the electrode to be retracted after the lighter flame is established. This provision is intended to avoid overheating the high energy electrode. Also shown are a high energy ignitor power supply unit 11, power supply cable 12, atomizing air/steam supply 15, oil supply 16, and oil atomizer 17.

The operating sequence for start-up is unit specific and depends on the configuration of burners and pulverizers and the operating philosophy of the company using the burner. One type of operating sequence for start-up of the ignitors is illustrated in FIG. 4. The critical step in the light-off sequence is the trial for ignition. At the end of this 15 second period the spark probe is de-energized and retracted. At this time all five ignitors in a row must be proven by the flame detectors. If not, the control system terminates ignition and initiates the purge and shutdown sequence. Multiple shut-downs and re-attempts to light and prove lighter flames are a typical occurrence during cold start-ups.

In addition to oil sprays which do not ignite, it is not unusual for the flame detectors to fail to prove an existing flame. FIGS. 3*a* and 3*b*, the atomizer 17 is an air-atomized, light-oil, 5 orifice y-jet design. These atomizers produce flames with 5 distinct "fingers". With an 80° spray angle for the atomizer, the distance between flame "fingers" is generally the same as the axial distance from the atomizer at which the flame is viewed. For example, there is a 12-inch gap between flame "fingers" 12 inches from the ignitor. The orientation of the atomizer exit holes with respect to the flame detector is random. Therefore, it is possible that the failure of a flame detector to prove an established flame results from the detector sighting in on the gap between adjacent flame "fingers".

In either case (ignition failures or failure to prove lit flames), approximately 0.4–0.5 gallons of light oil is sprayed into the boiler for each unlit ignitor. A further contribution results from purging fuel from all five ignitors (including those that had been firing). This unburned oil can deposit on boiler surfaces, particularly in the convective passes and the air heater. As temperatures rise, oil retained in the boiler will re-vaporize into the gas flow. Therefore, failures to light and prove ignitor flames, can affect opacity at the time of attempted light-off and for several hours later. Typical opacity levels for cold start-ups are greater than 40% for up to several hours.

In addition to opacity resulting from lighter start-up problems, smoke is consistently observed in the furnace after the lighter flames are established. As shown in FIG. 5 (the opacity chart record for a prior cold start) the combined affects of both mechanisms results in opacity exceeding 10% for approximately 4 hours of the 4 hour and 50 minute period between the start of lighter fuel flow and the energization of the precipitator.

SUMMARY OF THE INVENTION

The objective of the smokeless ignitor of the present invention is to develop a consistently ignitable and stable flame, having a minimum radiative surface area and a high volumetric heat release rate. The flames must be attained under adverse combustion conditions such as cold boiler walls with high energy absorption, ambient temperature combustion air, high air velocities and high air to oil fuel ratios. Converting these flame characteristics into hardware specifications requires the integration of oil spray properties, flame stabilizer performance, and the burner aerodynamics in the ignitor region.

While a generic atomizer and a generic flame stabilizer components which comprise the smokeless ignitor are not novel, the present invention has integrated the parameters which control flame characteristics (the size distribution, spray angle and spatial uniformity of the atomized oil, and the flame surface geometry and combustion product mass recirculation rate within the flame envelope) into a design for an atomizer and flame stabilizer which, for the first time, meets the technical requirements for cold, smokeless start-up of utility boilers.

Oil vaporization rate and oil/air mixing requirements for smokeless flames are provided by optimizing atomizer performance to produce a Sauter Mean Diameter (SMD) less than 150 microns when measured at a location 12 inches from the atomizer tip along the jet axis. The mass distribution in the atomized spray is characterized by the Spatial Transport Uniformity parameter (STU), derived from the distribution of oil mass flow per unit spray area in a plane perpendicular to the spray axis 12 inches from the atomizer. The STU value is expressed as a percentage deviation from the mean. A minimum STU value is desired.

An internal mixing dual-fluid (air or steam) atomizer, operated with a constant pressure differential between the oil and the atomizing fluid, was selected as the most appropriate generic design to satisfy the oil spray requirements although other atomizer designs may be used if desired. The atomizer designed for the smokeless ignitor produces a spray SMD less than 120 microns (i.e., a preferred range of 50–90 microns with a recommended range of 65–75 microns) and an STU value of ±50% (or less).

The smokeless ignitor satisfies flame stability and combustion requirements by establishing a flame with a 15–30% mass recirculation rate (with a preferred rate of 20–25%) and a recirculation zone length of 0.75 to 1.50 effective throat diameters (measured along the ignitor axis). The recirculation zone length depends upon the specific geometry of the burner. The ignitor design is based upon the integration of the oil spray properties (above) with a flame stabilizer, an oil spray angle of 55°–100° (where a preferred angle range is 70°–90°, the most preferred range is 75°–85°), and the main burner aerodynamics.

While the data and test results hereinunder represent data from tests conducted at the Brandon Shores Station of Baltimore Gas and Electric, the present invention is not limited thereto and cover all modifications falling within the true spirit and scope of the invention.

BRIEF DESCRIPTION OF THE DRAWINGS

FIG. 3*a* is a prior art ignitor assembly while

FIG. 9 shows prior art variation of particulate emissions with air preheat;

FIG. 11 shows the prior art relationship between flame length and axial mixing factor;

FIG. 16 shows an example of a bluff body flame stabilizer of the present invention;

FIG. 18 shows the opacity during cold start-up with the present invention; and

Description of the Preferred Embodiment

Large fossil-fueled powered steam generators often use distillate oil-fired ignitors to ignite and provide stability for pulverized coal flames. In some instances, during cold start-up, the ignitors are used to warm up the boiler surfaces and initiate steam generation before coal is introduced to the boiler. In this period, soot particles, resulting from incomplete combustion of vaporized hydrocarbons, result in excessive opacity unless the boiler is hot or the electrostatic precipitator is energized. The object of the present invention is to eliminate visible opacity related to the oil-fired ignition by modifying the combustion characteristics of the ignitor flames.

During the start-up period, four conditions exist which are not the norm for liquid fuel firing in utility boilers and which adversely impact the stability of the flames and completeness of combustion: a) the combustion air is initially at ambient temperature, b) the cold boiler walls act as black-body heat sinks for flame radiation, c) inter-flame energy transfer is minimized and d) the ratio of air to oil is several times the stoichiometric mixture. The present invention developed oil atomization and flame stabilization hardware and operating procedures which resolve deficiencies in current equipment and produce stable, high intensity ignitor flames under some or all of these four conditions.

In boiler applications, the term "opacity" is used as a descriptor (both qualitative and quantitative) of the interaction between light and light scattering properties of the flue gases or stack exhaust plumes. The mathematical expression for this interaction (known as the Beer-Lambert Law) is presented as Equation 1.

Equation 1

$$I/I_o = e^{-ACL}$$

Where:

$I_o$ = the intensity of the incident radiation
$I$ = the intensity of transmitted radiation
$L$ = the optical path length
$C$ = concentration of scattering matter entrained in the gases
$A$ = the attenuation coefficient:

-continued

| Equation 1 $I/I_o = e^{-ACL}$ |
|---|
| particle size |
| index of refraction |
| wavelength of incident light |

In generation practice, the reduction of transmitted radiation is expressed as % Opacity (rather than the fraction of transmitted to incident radiation, $I/I_o$). This involves a minor rearrangement of the Beer-lambert law as shown in Equation 2

$$\% \text{ Opacity} = 100 \times (1 - e^{-ACL}) \qquad \text{Equation 2}$$

The relative simplicity of equation 2 contrasts with the difficulty of accurately determining the attenuation coefficient associated with light scattering species in the flue gases. This is particularly true when these species are of the same dimensions as the wavelength of the incident light. In this case, there is a direct interaction between the electromagnetic properties of the incident radiation and the equivalent properties of the scattering medium.

Figure 6:
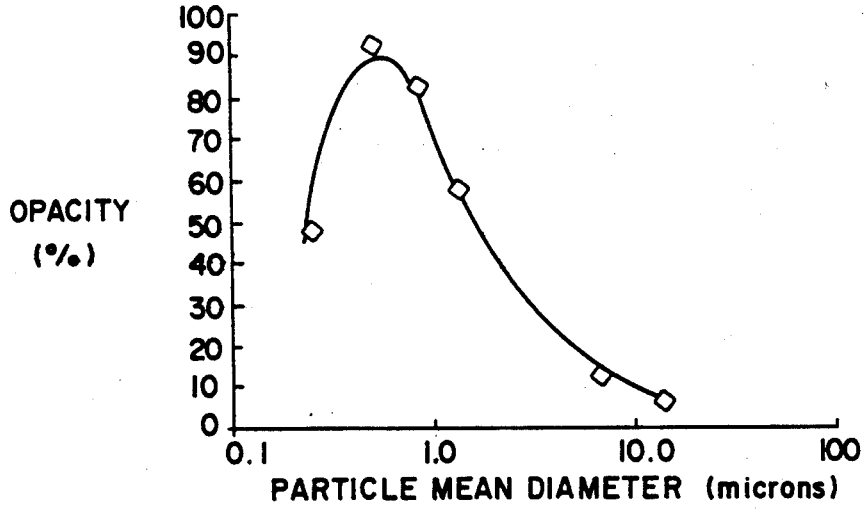
FIG. 6 PRIOR ART
FIG. 6 shows predicted prior art opacity versus particle size for constant mass.

For visible light, the most sensitive scattering region occurs with particle dimensions in the range of 0.3 microns to 0.8 microns. This condition is illustrated in FIG. 6, in which opacity is plotted as a function of particle size with the total mass of particles held constant. As shown in FIG. 6, particles with diameters greater than 10 microns exhibit opacity levels below 10%. In comparison, the same mass of particles in the 0.3 to 1.0 micron range can result in opacity levels greater than 50%. Thus, while the other parameters such as total mass emissions and refractive index are contributing factors to opacity, the prime requirement for the cold start-up application is to minimize the mass of submicron particles.

Figure 7:
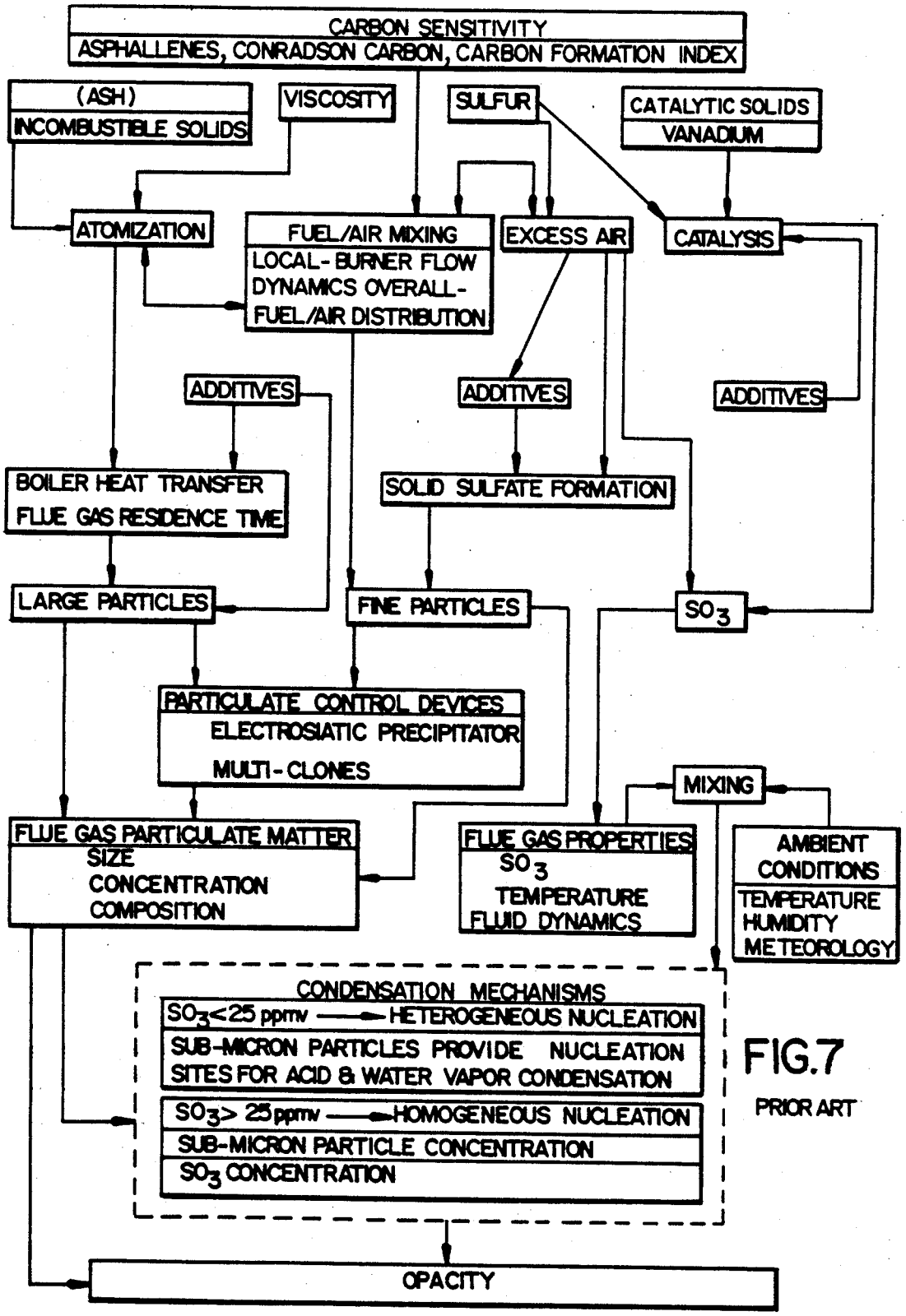
FIG.7 PRIOR ART
FIG. 7 shows prior art opacity process for oil-fired boilers.

The complexity of the opacity process for liquid fuel fired boilers is illustrated in FIG. 7.

In an oil-fired boiler, the oil is atomized into droplets which exhibit a size distribution dependent upon the asfired viscosity of the oil and the atomizer design and operation. In the furnace these droplets begin to vaporize, starting with the lighter hydrocarbons. If insufficient oxygen is present, these hydrocarbons can undergo successive dehydrogenation, ultimately yielding submicron carbon.

Figure 8:
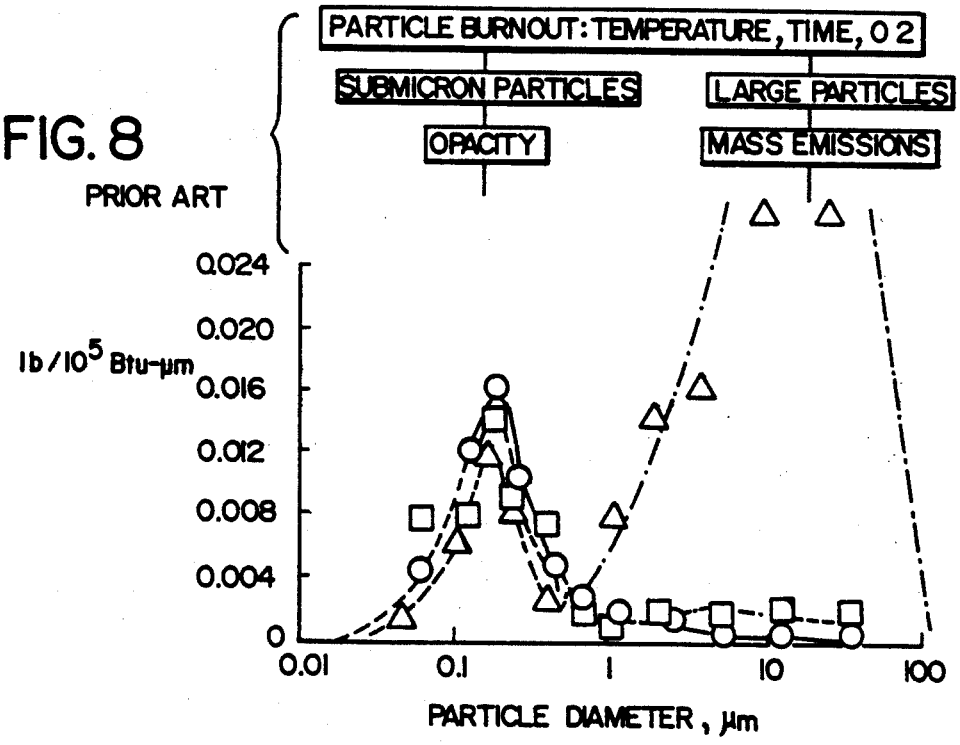
FIG. 8 PRIOR ART
FIG. 8 shows prior art particle characteristics from fuel oil combustion.

As the fuel droplets vaporize, they also increase in temperature. This internal heating continues until the remaining components lose their hydrogen atoms, yielding a moderately porous coke particle. The size of these particles depends upon the initial droplet size and the relative content of coke forming hydrocarbons in the oil. Once formed, carbonaceous particles (resulting from either of the above mechanisms) will burn completely if sufficient oxygen and residence times and temperatures are available. The combined effect of fuel properties, fuel/air mixing, atomization, and excess air levels results in a bi-modal particle size distribution, as shown in FIG. 8. Efforts to minimize opacity during cold start-ups are directed at those factors which control soot formation and burnout such as fuel/air mixing in the region close to the ignitor and the temperature/time history of the soot particles.

The temperature of the combustion air has a direct impact on the heat release/radiative loss balance in the flame. Lower temperatures extend the flame envelop through influences on fuel vaporization rates, fuel/air mixing, and combustion rates (thereby increasing radiative surface area for a fixed fuel flow). An example of changes in carbon emissions resulting from relative changes in combustion air temperature is illustrated in FIG. 9. Combustion criteria for minimum opacity cold start-up must account for the effect of the relatively low air temperature on combustion rates by modifications to the design and operating parameters which establish residence time in the higher temperature regions of the flame.

In the initial stages of boiler start-up, the furnace walls act as a black-body heat sink for energy radiated from the flame. Since the principal source of this radiation is from components in the outer surface of the flame envelope, the high emissivities of soot particles in this region promote high radiation transfer. The simultaneous effects from this process are a warming of the boiler surfaces and a decrease in soot particle temperature. If the soot falls below the ignition point, further combustion is halted. Since the particle is on the boundary of the flame, it has a high probability of exiting the boiler and thus contributing to opacity.

Figure 10:
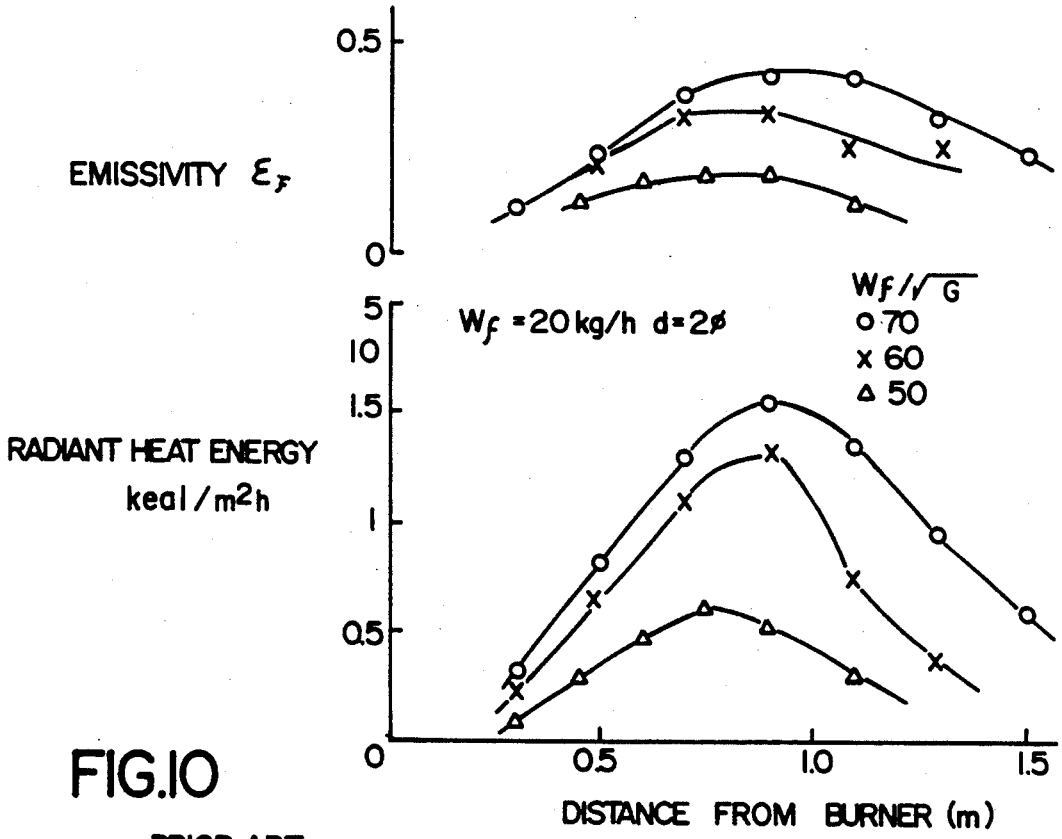
FIG.10 PRIOR ART
FIG. 10 shows the prior art effect of axial mixing factor on radiative hate flux, total emissivity and flame diameter.

Warming up the boiler without excessive soot-derived opacity requires a balance between heat release within the flame envelope and radiative losses to boiler surfaces. Correlations in the technical literature indicate that flame radiation is considerably influenced by the rate of fuel/air mixing, and that axial mixing can be used to provide a quantitative relationship between flame radiation and atomizing conditions. These correlations are based on a parameter called the axial mixing factor, which is defined as atomizer fuel flow rate, $W_f$, divided by the square root of the momentum of the fuel jet sprayed by the atomizing medium, G. FIG. 10 shows the results of experiments measuring the heat flux of radiation, the total emissivity, and the diameter of the flame for varying axial mixing factors.

The relationship between axial mixing factor and the length of the flame is shown in FIG. 11. As can be seen, as the axial mixing factor decreases (better mixing), the heat flux of flame radiation and the flame emissivity both decrease. This results in physically smaller flames and subsequently, an increase in the volumetric heat release.

We have, thus, found that opacity during cold start-up with oil fuels is a direct result of the formation of submicron soot particles and the quenching of the combustion of these particles before they can burn completely. Minimizing this effect requires flames with high fuel/air mixing and volumetric heat release rates.

Figure 12:
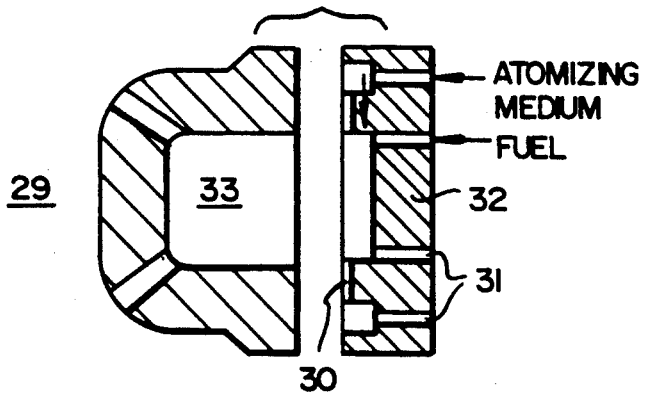
FIG. 12 shows the basic design of the internal mixing atomizer of the present invention.

The smokeless ignitors of the present invention provide spark ignitibility, a stable flame with approximately 30% of the full load air flow through the burners, consistent proving of the ignitor flame with an existing, flame detection system and are capable of igniting a coal flame from a burner. The atomizer of the present invention must provide an oil spray SMD on the order of 120 microns or less to establish desired flame characteristics. A preferable range of SMD is 50–90 microns and the optimal range is 65–75 microns. The mass flow uniformity of the oil spray as quantified by the Spatial Transport Uniformity (STU) parameter, should not exceed ±50%. As shown in FIG. 12, in the internal mixing atomizer 29, the oil and atomizing medium impact at 90° angles through a number of ports 31 and slots 30, either in an intermediate mixing plate 32, or incorporated into the rear surface of the atomizer tip 33. The spray angle of the atomizer must be between 55° to 100°. A preferred range is between 70°-90° and preferably 75°-85°.

Preferred internal atomizers have 8 to 10 ports. However, the invention is not limited thereto. The exact design of the atomizer will depend upon the air flow, main burner geometry and burner operating variables but will always have an SMD of less than 120 microns, an STU value of 50% or less and a spray angle between 55°-100°.

Significant features of the preferred internal mixing design for the ignitor include:

- The ability to accommodate either fuel or air in the center without affecting atomization quality.
- The number of individual exit holes can be increased more readily than with a Y-jet. This provides a capability for developing a more uniform fuel distribution in the oil spray, (i.e., lower STU value).
- Orifice size can be increased to prevent plugging without significantly affecting spray quality.
- The condition of the atomizer components can be visually assessed; particularly compared to the Y-jet in which the critical oil/air intersection point and mixing chamber surface are imbedded in the spray plate.

Figure 19:
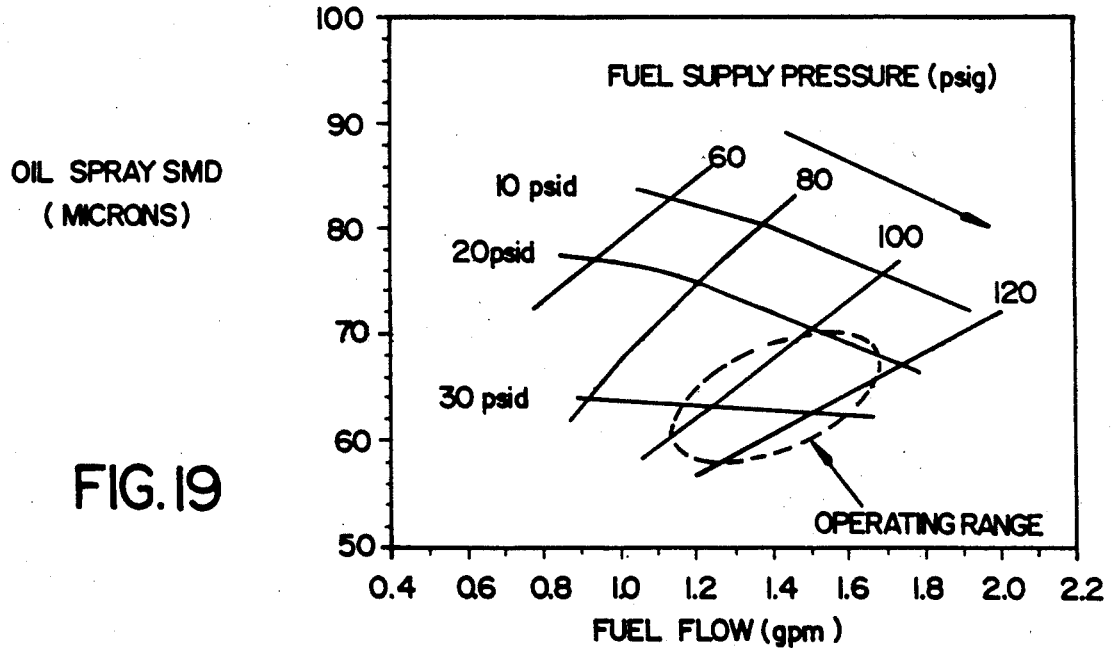
FIG. 19 shows the test results for the fuel spray produced by the atomizer of the present invention.

An internal mixing atomizer of the present invention was designed to meet the spray and operating requirements specified above. A prototype was fabricated and performance characteristics quantified in an atomizer laboratory. The test results, shown in FIG. 19, verified that the atomizer satisfied all of the design objectives. Although the internal mixing atomizer was used in the tests for the present invention, the invention does not exclude use of Y-jets or other atomizers provided they produce an SMD of less than 120 microns, an STU value of 50% or less and a spray angle between 55°-100°.

Figure 13:
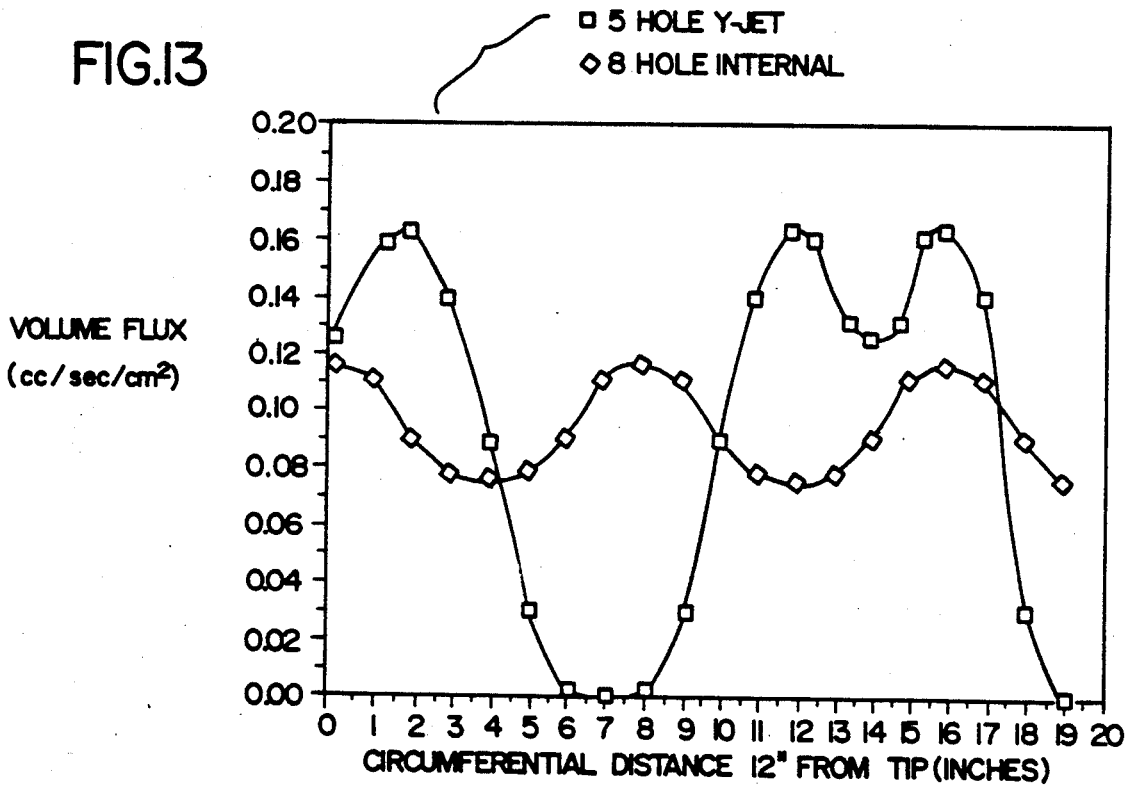
FIG. 13 compares the volume flux distribution of a Y-jet atomizer and the internal mixing of the present invention.

A Phase Doppler Particle Analyzer (PDPA), used to characterize the atomized sprays, measures droplet velocity and volume flux in addition to the droplet size distribution. Measurements of the volume flux between the centerlines of adjacent spray jets for the standard atomizer with 5 jets and the internal mixing atomizers with 8 jets of the present invention are compared in FIG. 13, where the zero position is a centerline of an individual jet.

The data for the Y-jet exhibits two reasonably symmetric peaks on either side of the jet axis. This result is consistent with the Y-jet atomizing mechanism. The indicated improvement in spray flux distribution with the internal mixing design of the present invention is a combined result of better atomization and the increased number of fuel jets.

The preferred internal mixing atomizer used in the present invention provides improved spray uniformity compared to standard atomizers. The combination of smaller drops and more uniform fluxes with the new design, increases the oil vaporization rate and accelerates flue/air mixing, both of which enhance combustion in the near burner zone.

In addition to atomizer improvements, the flame stability and burner aerodynamics in the ignitor region were improved (for both light-oil start-up and coal ignition) through the installation of an ignitor flame stabilizer and the specification of appropriate register and vane settings.

Figure 14:
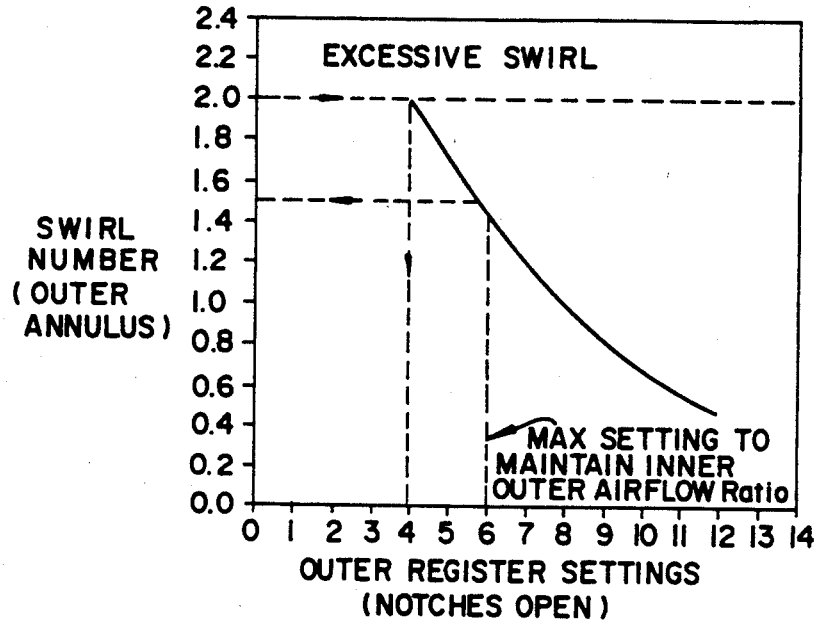
FIG. 14 shows the swirl number versus control lever settings.

For example, for a dual-register burner (although the present invention is not limited to a dual-register burner and may be used with a single register burner or rectangular burners located at the corners of boilers), the outer register settings affect both air flow and swirl. In contrast, the inner register setting establishes the air flow in the inner annulus while the swirl is independently controllable by the spin vanes. The inner/outer annulus air flow split, air velocity, momentum, flow angle, static pressure, swirl number, pressure losses and recirculation parameters were computed as a function of register and spin vane angles using a burner internal aerodynamics computer code. Meeting flame criteria for cold light-off at the ignitor firing position required that the inner register be set close to the full open position (notch settings from 13-15 for the Brandon Shores boilers). The relationship between swirl number and notch settings for the outer register is presented in FIG. 14. As illustrated in FIG. 14, an upper boundary on swirl number was established to avoid jet-type flow due to excessive recirculation while the lower boundary was set by air flow requirements. The result is an operating range of 4-6 notches for the Brandon Shores boilers, for the outer register which results in a 1.5-2.0 range in swirl number.

Figure 15C:
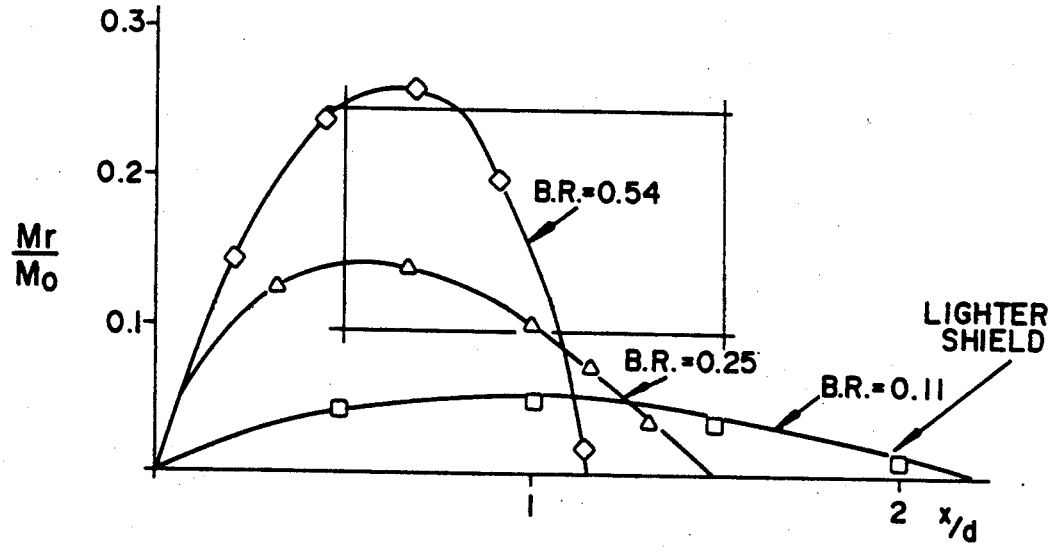
FIG. 15C PRIOR ART
FIGS. 15A–15C show the effect of flame stabilize geometry on near zone burner aerodynamics.
Figure 15A:
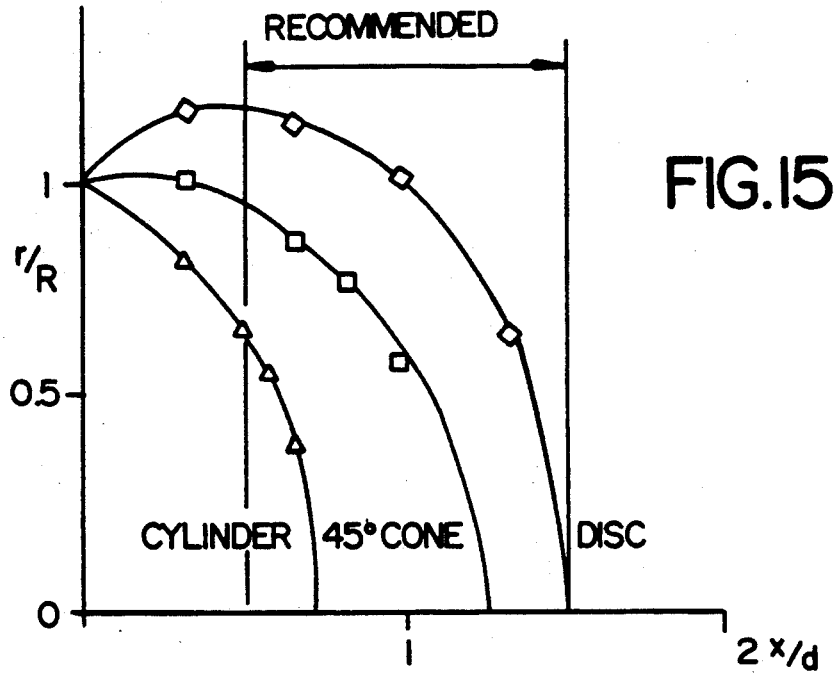
Figure 15B:
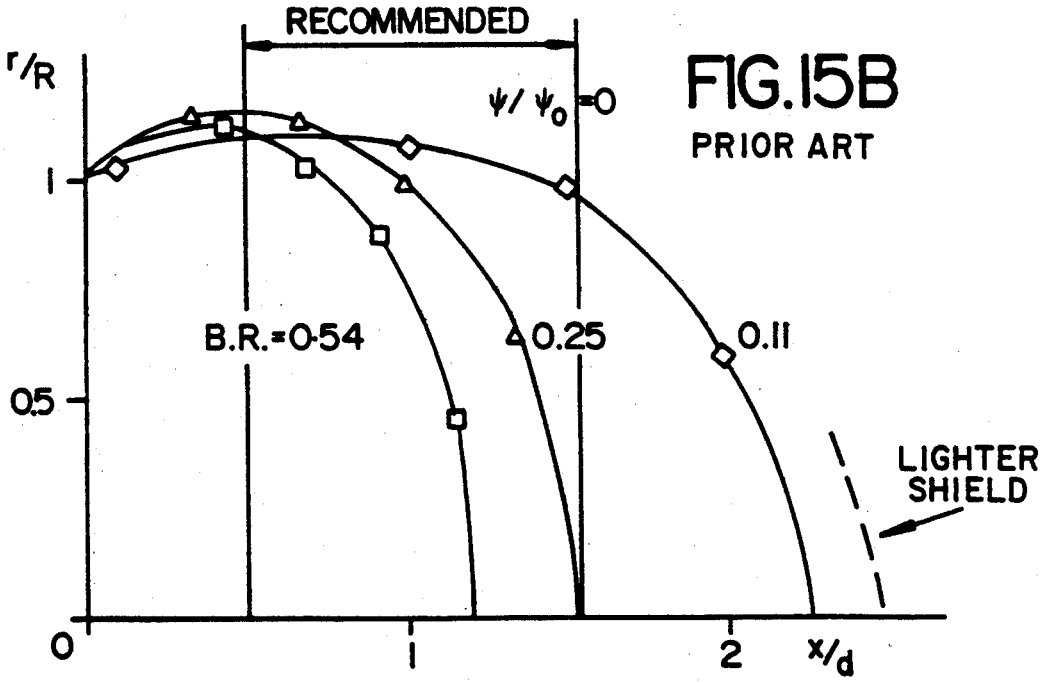
FIG.15B PRIOR ART

While not as effective as a properly matched swirler, the low velocity region behind a bluff body is often utilized for flame stability. Relationships between the specific geometry of the bluff body and recirculation zone characteristics are presented in FIGS. 15A-15C. Recommended operating envelopes (based upon experience) are also indicated.

Figure 1:
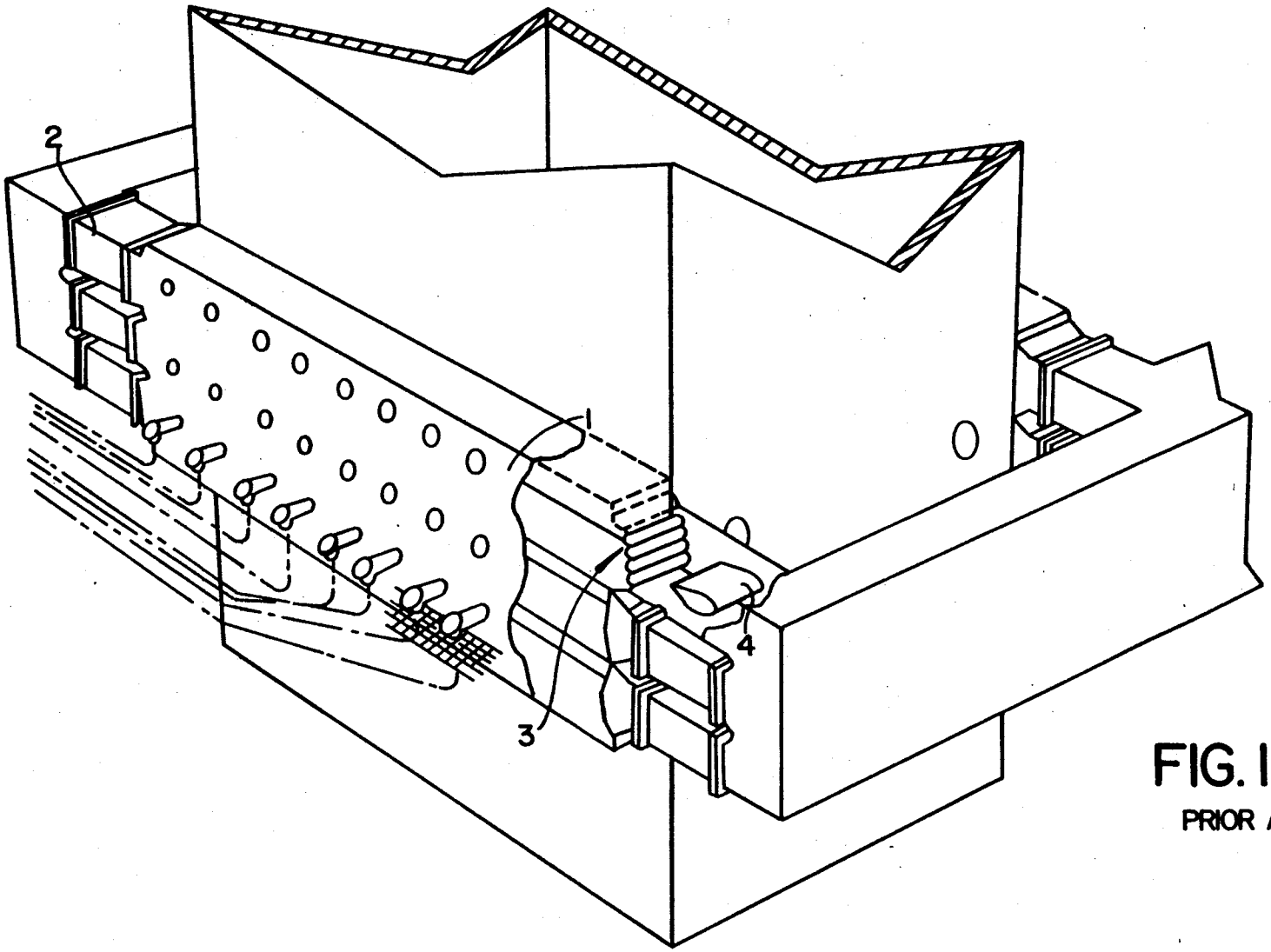
FIG. 1 PRIOR ART
FIG. 1 is a typical prior art compartment windbox.
Figure 2:
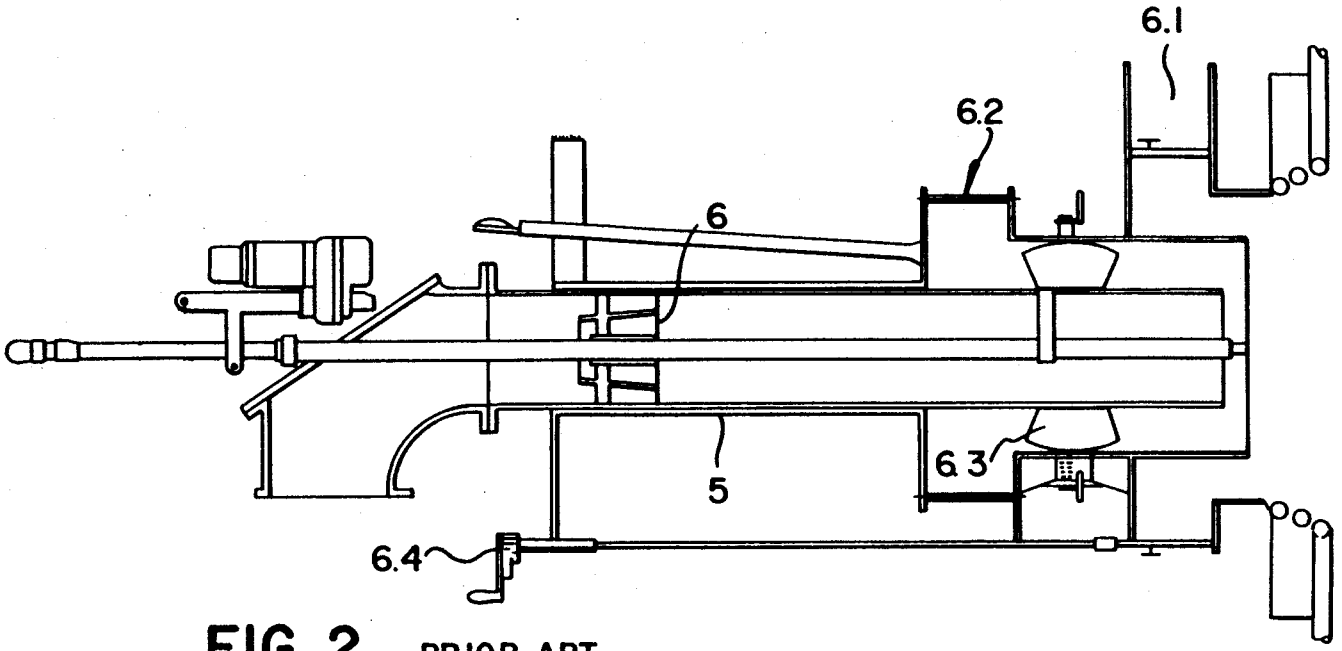
FIG. 2 PRIOR ART
FIG. 2 is a prior art burner cross-section.
Figure 3B:
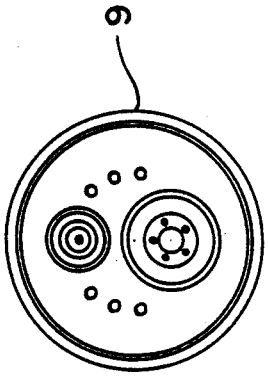
FIG. 3b PRIOR ART
FIG. 3*b* shows an end view of the ignitor assembly.
Figure 3A:
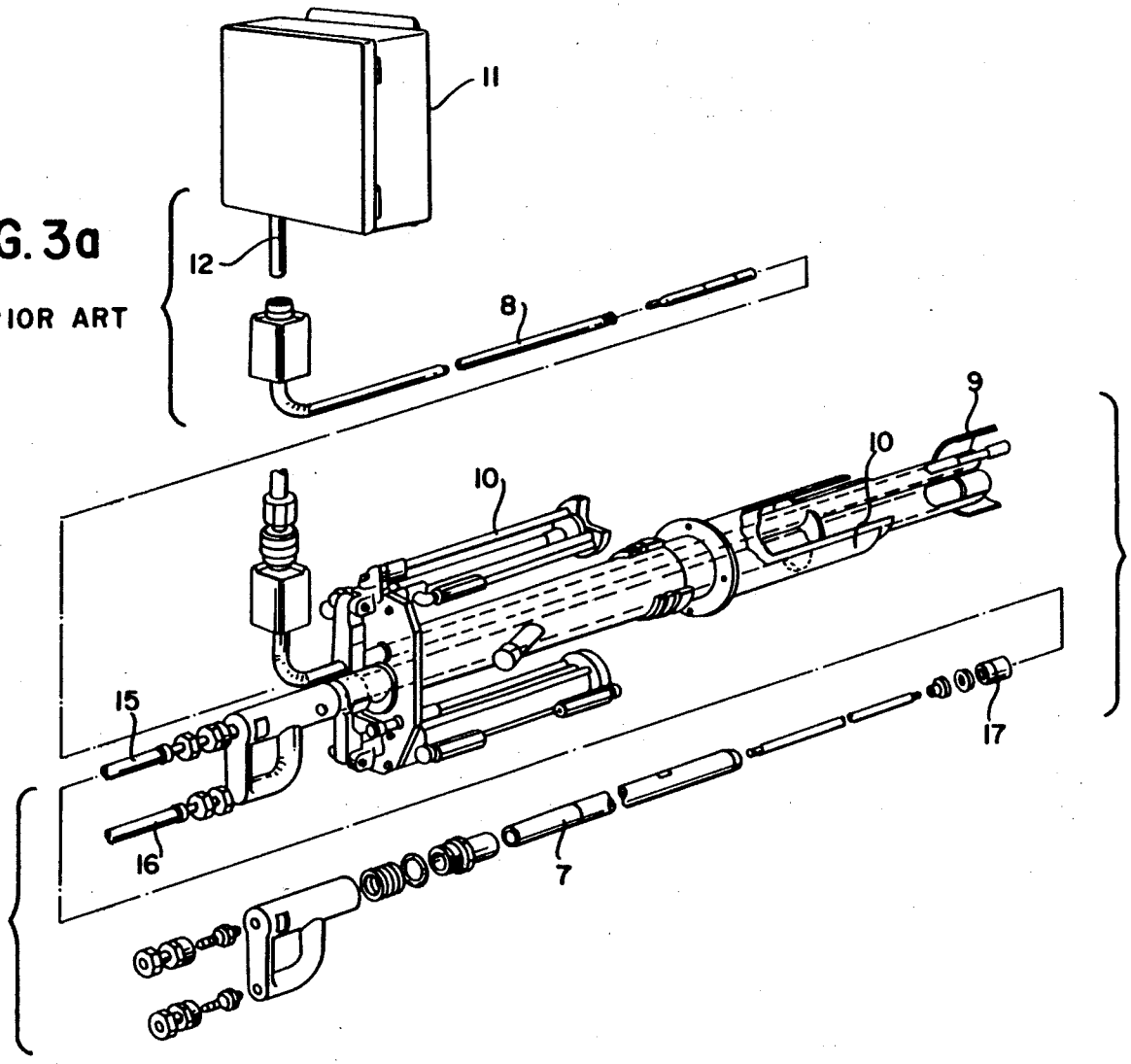
FIG. 3a PRIOR ART
Figure 4:
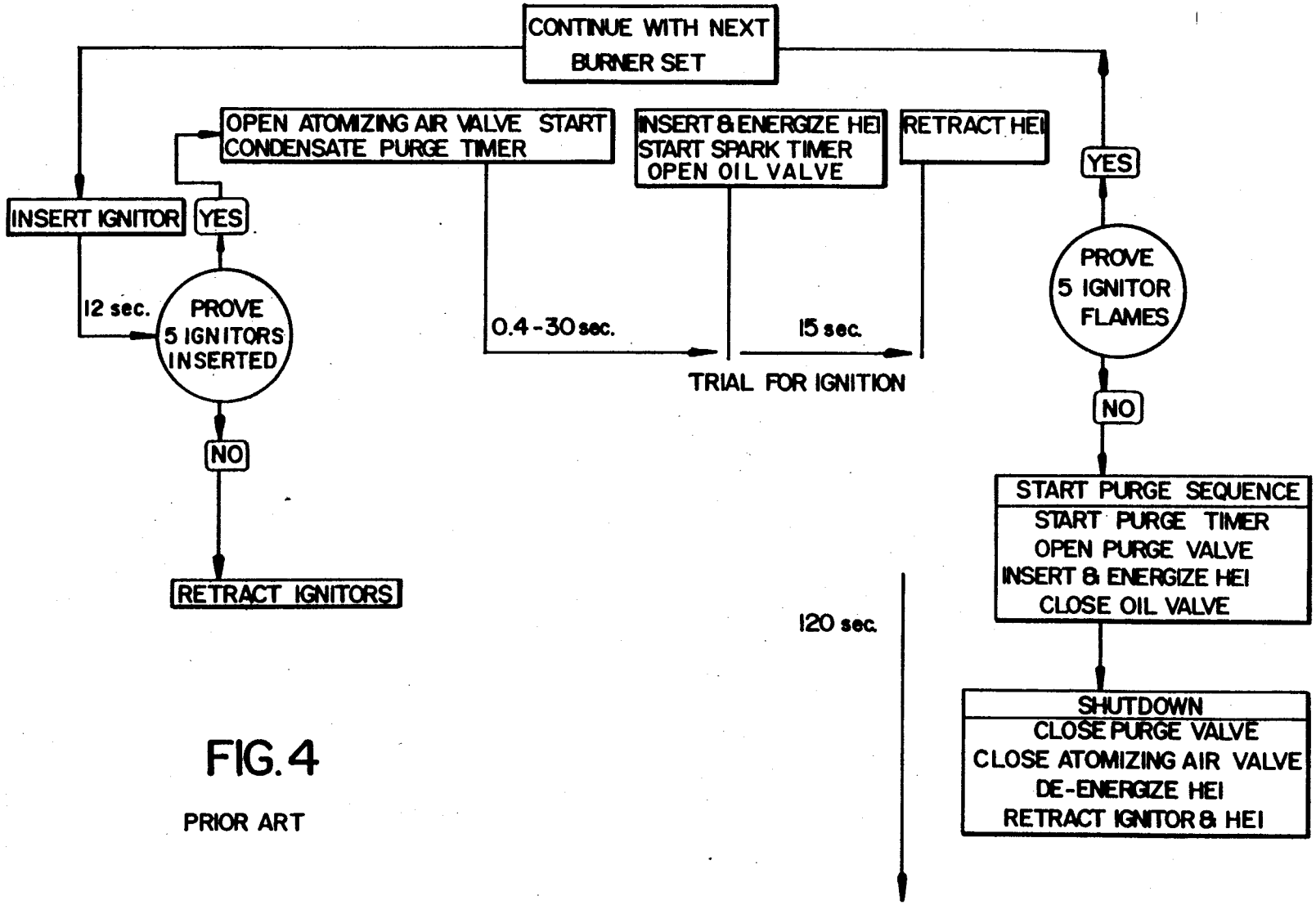
FIG. 4 PRIOR ART
FIG. 4 shows the prior art ignitor start-up procedure.
Figure 5:
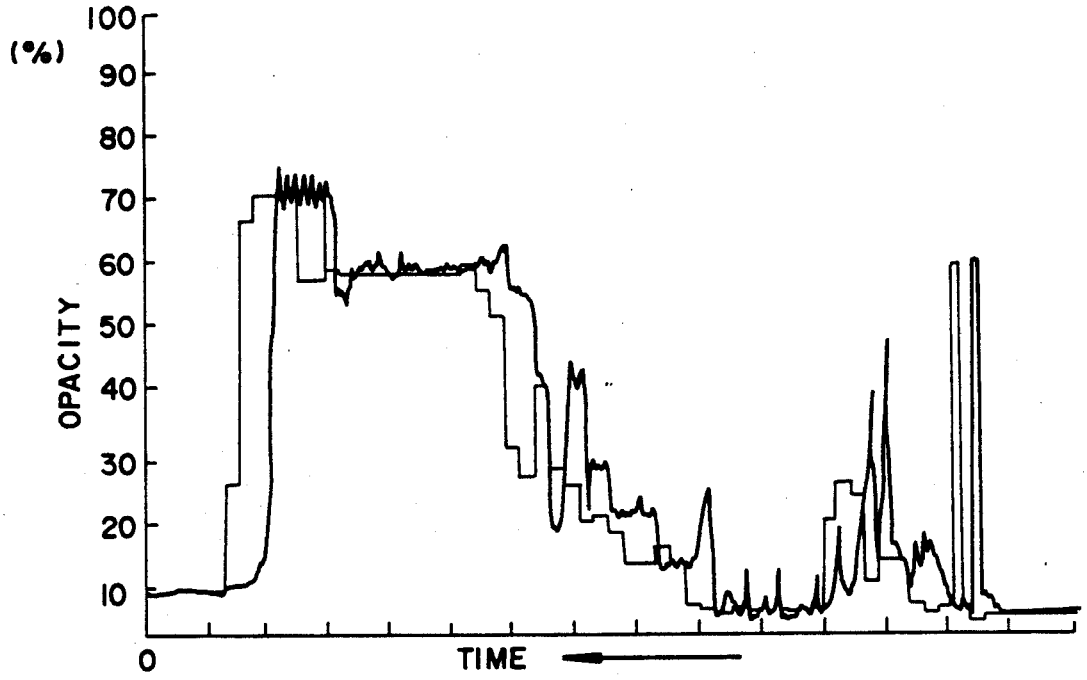
FIG. 5 PRIOR ART
FIG. 5 shows the prior art opacity during another cold start-up.

The lighter shield incorporated in the standard 20 ignitor is typically a 3.75 inch diameter cylinder (FIG. 3). This geometry does not satisfy criteria for reliable ignition, or produce desired recirculation zone characteristics identified in FIGS. 15A-15C. Once ignited, the flame will remain stable. However, the minimal recirculation rate (estimated at 5% from FIG. 15) is inadequate for establishing a minimum opacity flame.

A bluff body flame stabilizer, designed to produce a recirculation zone geometry and mass recirculation rate within the recommended limits for the present invention, while remaining compatible with the internal burner aerodynamics, is illustrated in FIG. 16. As shown, the bluff body flame stabilizer 34 has a 140° included angle cone with 85% blockage area 35 and a 5.75 inch outer diameter. However, the present invention is not limited to the design of FIG. 16, but will vary depending upon the particular burner where the flame stabilizer is installed. In particular, the bluff body flame stabilizer design must satisfy the requirements of forming a recirculation zone having a length of 0.75 to 1.5 burner throat diameters (or hydraulic diameters in the case of rectangular burners) and a mass recirculation rate of 15 to 30% with a preferred mass recirculation rate of 20-25%.

Figure 17:
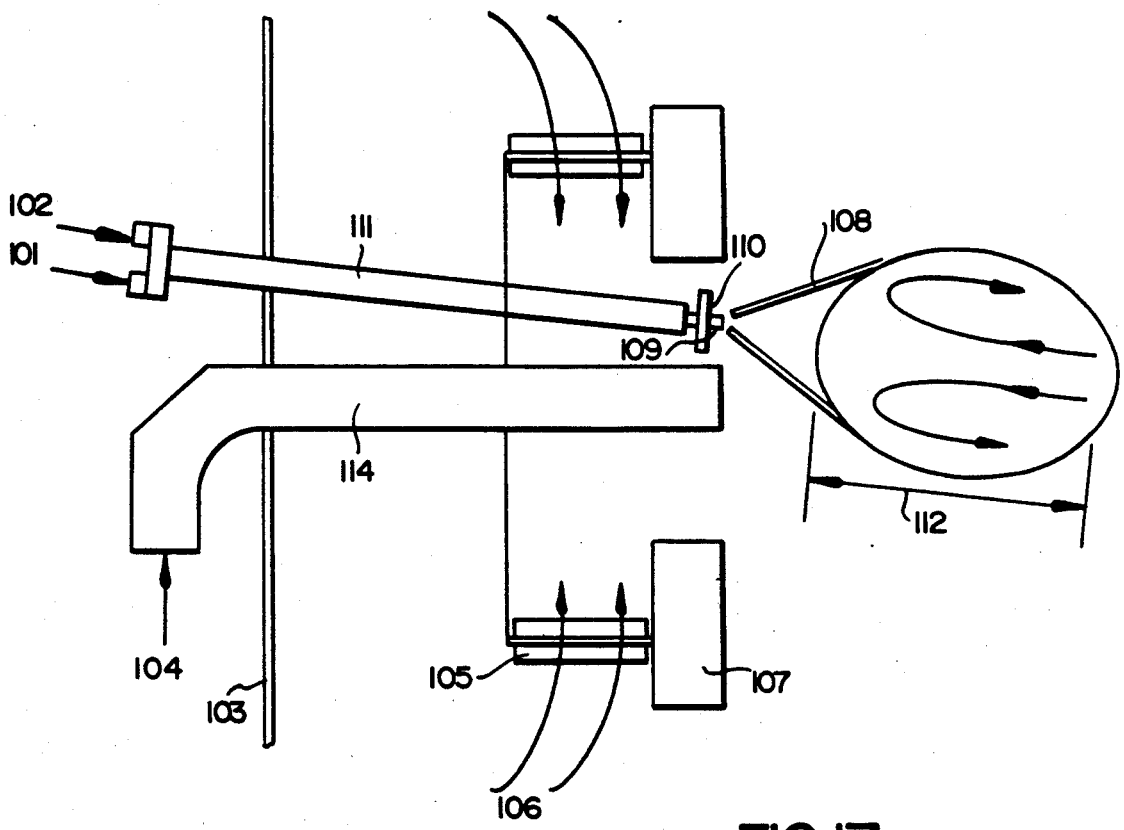
FIG. 17 shows a general configuration of the present invention as used in a single register burner.

FIG. 17 shows an example of the present invention which could be used in a single register burner. The fossil fuel and primary air 104 are fed through the windbox wall 103 and through the burner throat in the boiler furnace wall 107 through a central pipe 114. Secondary combustion air 106, provided by fans (not shown), is fed into the windbox; from which it flows through the burner registers 105 and into the furnace. The ignitor 111 includes an atomizer 109 and an ignitor flame stabilizer 110. The atomizer 109 has two feed means 101 and 102 for input of, for example, oil and atomizing fluid such as air or steam. The alignment of the atomizer 109 and ignitor flame stabilizer 110, a spark ignitor (not shown), flame sensor (not shown) and other main burner components can vary among burner designs. An asymmetric placement of the ignitor 111 with respect to the burner centerline is indicated in FIG. 17. However, the present invention is not limited to this design.

The critical aspects of the present invention illustrated in FIG. 17 are the spray zone 108 and the recirculation zone 112. The spray cone angle must be between 55° and 100° with a preferred range of 70°-90°, and a more preferred range of 75°-85°. The recirculation zone length 112 must be between 0.75 to 1.5 burner throat diameters and depends upon the specific geometry of the burner.

In addition, the mass recirculation rate must be 15-30% (and preferably 20-25%). The Sauter Mean Diameter (SMD) of the spray of the atomizer must be less than 120 microns (and preferably in the range of 50-90 microns and optimally in the range of 65-75 microns) and have an STU value of ±50% or less when operated with a preferred air to oil mass ratio of 0.20 to 0.30 and an atomizing air to oil pressure differential greater than 20 psig. An amount of air which is stoichiometric or greater must be provided in the ignitor firing position such that it can mix with and completely burn the ignitor oil.

For dual register burners, the ignitor flame is dominated by the secondary air flow. In one test, the smokeless ignitor was designed for a secondary air flow rate of 55-60% of the total burner air flow and a swirl number from 0.6 to 1.0. The corresponding range of swirl numbers for the tertiary (outer register) air flow is 1.5 to 2.0. These parameters are based upon an oil spray angle of 75 to 85 degrees and a bluff-body conical diffuser with the following characteristics:

| | |
|---|---|
| Diffuser Blockage Ratio: (The ratio of the area of the diffusers to the are of the ai flow affected by the presence of the diffuser). | 0.2-0.4 |
| Diffuser Open Area: (The total area of holes in the diffuser as a fraction of the total diffuser area - for cooling and limited air admission). | 0.10-0.20 |
| Air Mass Loading: (The air mass flow per unit area of the diffuser). | 0.016-0.024 |

The atomizer tip for this test is positioned 0.5 to 1.0 inches downstream of the diffuser hub. The corresponding position of the spark electrode is from 2.25 to 3.0 inches from the exit plane of the diffuser. The firing position for the ignitor is 4.5 to 5.5 inches downstream of the shroud which separates the inner and outer air flows.

The design criteria specified above for dual register burners are also directly applicable to single register burners. The principal differences for a simple register burner is the specification of appropriate air flows, main burner geometry, and burner operating variables.

The diffusers are preferably fabricated from 310 stainless steel. The atomizers are preferably machined from H 13 tool steel and hardened to a Rockwall # of 50-53. These materials were selected based upon prior experience with similar combustion hardware. Alternative materials can be used (if necessary) to address specific problems or applications, without affecting the smokeless ignition characteristics.

Cold starts and transitions to steady state flames were performed with the flame stabilizer and 8 and 10 hole 70° and 80° spray angle internal mixing atomizers. The opacity readout remained under 4% for all conditions (other than an initial spike due to combustion control system transients) and no emissions could be observed from the stack. The opacity record for a cold boiler start with the present invention (FIG. 18), shown that the only detected opacity movements in this period were an instrument calibration and during operation of the electrostatic precipitator rappers shortly before the precipitator was energized.

The smokeless ignitor requires the integration of specific designs for atomization and flame stabilization into one system. How these two systems are combined, under the constraints for a cold start-up, is unique and results in the dramatically improved performance relative to conventional smoky ignitors. For example, it is accomplished using combustion air from main burners at 25-30% purge flow rates and does not require an independent source of combustion air that is specifically metered and directed to support ignitor requirements.

From the foregoing description of the preferred embodiment of the invention, it will be apparent that many modifications may be made therein. It should be understood that these embodiments are intended as one example of the invention only, and that the invention is not limited thereto. Therefore, it should be understood that the appended claims are intended to cover all modifications that fall within the true spirit and scope of the invention.

What is claimed is:

1. A furnace comprising a main burner adapted to burn heavy hydrocarbonaceous feed comprising means to admix a liquid or solid combustible fuel with less than a stoichiometric quantity of air to form a fluidized fuel; means for mixing this fluidized fuel with additional air sufficient to at least approximate a stoiciometric mixture of fuel and air; and means for igniting said fuel; wherein said igniting means is disposed in a throat of said main burner and is also operative to heat said furnace from an ambient temperature condition to a heated operating temperature condition, while minimizing the emission of smoke to not substantially more smoke than is emitted by combustion of said fluidized fuel in said main burner after said furnace has been warmed up to operating temperature by the heating action of said ignitor, prior to ignition of the fuel in said main burner;

which ignitor means comprises:

means for feeding liquid fuel to said ignitor; means for atomizing said liquid fuel with an atomizing fluid and admixing such with combustion air into a spray, with a Sauter Mean Diameter (SMD) of less than 120 microns, and a Spatial Transport Uniformity value of +/−50% or less; means to spray said admixture into said furnace; and flame stabilizing means disposed in said furnace operatively associated with said spray means, adapted to control said sprayed admixture into a spray cone angle of 55° to 100°, said spray means and said flame stabilizing means cooperating to spray said admixture into a recirculation zone within said furnace having a longitudinal dimension of about 0.75 to 1.5 times the diameter of said throat; said recirculation zone being so designed and operated that 20 to 25% of the mass of fluids therein are recirculated; and high energy means for igniting said sprayed mixture of liquid fuel and air to form a heating flame within said recirculation zone, whereby heating said furnace to said heated operating temperature condition by means of said flame in said recirculation zone; and, means, operative after said furnace has been heated by said flame from said ignitor to said heated operating temperature condition, for feeding said fluidized fuel and combustion air to said main burner; whereby igniting such with the flame of said ignitor whereby to operate said furnace.

2. A furnace according to claim 1 wherein said spray means is an internal mixing atomizer.

3. A furnace according to claim 2 wherein said atomizing fluid and liquid fuel impact at an angle of 90° on an intermediate mixing plate of the internal mixing atomizer.

4. A furnace according to claim 2 wherein said atomizing fluid and liquid fuel impact at an angle of 90° on a rear surface of a tip of said atomizer.

5. A furnace according to claim 2 wherein said atomizer has a plurality of holes.

6. A furnace according to claim 1 wherein said cone angle is 140° with an 80% blockage area.

7. A furnace according to claim 1 wherein said atomizing fluid is air.

8. A furnace according to claim 1 wherein said atomizing fluid is steam.

9. A furnace according to claim 1 wherein said Sauter Mean Diameter is 50–90 microns.

10. A furnace according to claim 1 wherein said Sauter Mean Diameter is 65–75 microns.

11. A furnace according to claim 1 wherein said spray cone angle is 70°–90°.

12. A furnace according to claim 1 wherein said spray cone angle is 75°–85°.

13. A furnace as claimed in claim 1 wherein said fluidized fuel is coal and said atomizing fluid is less than a stoichiometric quantity of air.

* * * * *